US010812900B2

(12) United States Patent
Khenkin et al.

(10) Patent No.: US 10,812,900 B2
(45) Date of Patent: Oct. 20, 2020

(54) SMART SENSOR FOR ALWAYS-ON OPERATION

(71) Applicant: INVENSENSE, INC., San Jose, CA (US)

(72) Inventors: Aleksey S. Khenkin, Nashua, NH (US); Fariborz Assaderaghi, Emerald Hills, CA (US); Peter Cornelius, Soquel, CA (US)

(73) Assignee: INVENSENSE, INC., San Jose, CA (US)

( * ) Notice: Subject to any disclaimer, the term of this patent is extended or adjusted under 35 U.S.C. 154(b) by 740 days.

(21) Appl. No.: 14/293,502

(22) Filed: Jun. 2, 2014

(65) Prior Publication Data

US 2015/0350770 A1 Dec. 3, 2015

(51) Int. Cl.
*H04R 3/00* (2006.01)
*H04R 17/02* (2006.01)
(Continued)

(52) U.S. Cl.
CPC ..... *H04R 3/00* (2013.01); *H04R 19/005* (2013.01); *H04R 19/04* (2013.01); *H04R 2499/11* (2013.01)

(58) Field of Classification Search
CPC ..... H04R 2499/11; H04R 2201/003; H04R 19/04; H04R 1/406; H04R 2410/00; H04R 1/342; H04R 9/08; H04R 1/222
(Continued)

(56) References Cited

U.S. PATENT DOCUMENTS 7,492,217 B2 2/2009 Hansen et al.
8,934,649 B1 1/2015 Lee et al.
(Continued)

FOREIGN PATENT DOCUMENTS

CN 101141828 A 3/2008
CN 201312384 Y 9/2009
(Continued)

OTHER PUBLICATIONS

International Search Report and Written Opinion dated Aug. 25, 2015 for PCT Application Serial No. PCT/US2015/033600, 12 pages.
(Continued)

*Primary Examiner* — George C Monikang
(74) *Attorney, Agent, or Firm* — Amin, Turocy & Watson, LLP

(57) ABSTRACT

Smart sensors comprising one or more microelectromechanical systems (MEMS) sensors and a digital signal processor (DSP) in a sensor package are described. An exemplary smart sensor can comprise a MEMS acoustic sensor or microphone and a DSP housed in a package or enclosure comprising a substrate and a lid and a package substrate that defines a back cavity for the MEMS acoustic sensor or microphone. Provided implementations can also comprise a MEMS motion sensor housed in the package or enclosure. Embodiments of the subject disclosure can provide improved power management and battery life from a single charge by intelligently responding to trigger events or wake events while also providing an always on sensor that persistently detects the trigger events or wake events. In addition, various physical configurations of smart sensors and MEMS sensor or microphone packages are described.

25 Claims, 11 Drawing Sheets

(51) Int. Cl.
*H04R 9/06* (2006.01)
*H04R 19/04* (2006.01)
*H04R 19/00* (2006.01)

(58) Field of Classification Search
USPC ..... 381/111–115, 122
See application file for complete search history.

(56) References Cited

U.S. PATENT DOCUMENTS

| | | | | |
|---|---|---|---|---|
| 2005/0114583 | A1* | 5/2005 | Beale | G06F 13/28 710/308 |
| 2006/0034472 | A1 | 2/2006 | Bazarjani et al. | |
| 2006/0237806 | A1 | 10/2006 | Martin et al. | |
| 2007/0127761 | A1 | 6/2007 | Poulsen | |
| 2008/0123891 | A1 | 5/2008 | Kato et al. | |
| 2008/0274395 | A1* | 11/2008 | Shuster | H01M 10/4257 429/61 |
| 2009/0091370 | A1* | 4/2009 | Kawasaki | H03J 3/20 327/365 |
| 2010/0183174 | A1* | 7/2010 | Suvanto | H04R 19/005 381/174 |
| 2011/0066041 | A1 | 3/2011 | Pandia et al. | |
| 2011/0075861 | A1* | 3/2011 | Wu | H03G 7/002 381/107 |
| 2011/0142261 | A1 | 6/2011 | Josefsson | |
| 2011/0208520 | A1 | 8/2011 | Lee | |
| 2011/0268280 | A1 | 11/2011 | Kawashima | |
| 2011/0278684 | A1 | 11/2011 | Kasai | |
| 2012/0300961 | A1 | 11/2012 | Moeller | |
| 2013/0208923 | A1 | 8/2013 | Suvanto | |
| 2013/0308506 | A1 | 11/2013 | Kim et al. | |
| 2014/0072151 | A1* | 3/2014 | Ochs | H04R 23/00 381/174 |
| 2014/0334643 | A1 | 11/2014 | Pinna et al. | |
| 2014/0343949 | A1 | 11/2014 | Huang et al. | |
| 2014/0348345 | A1* | 11/2014 | Furst | H04R 3/00 381/111 |
| 2015/0027198 | A1 | 1/2015 | Sessego et al. | |
| 2015/0256914 | A1 | 9/2015 | Wiesbauer et al. | |
| 2015/0281836 | A1 | 10/2015 | Nguyen et al. | |
| 2015/0350772 | A1 | 12/2015 | Oliaei et al. | |

FOREIGN PATENT DOCUMENTS

| | | | |
|---|---|---|---|
| CN | 102158787 | A | 8/2011 |
| CN | 103200508 | A | 7/2013 |
| WO | 2005055566 | A1 | 6/2005 |

OTHER PUBLICATIONS

Office Action dated Nov. 9, 2016 for U.S. Appl. No. 14/628,686, 49 pages.
European Search Report dated Nov. 27, 2017 for European Application No. 15803063.5, 11 pages.
Raychowdhury et al. "A 2.3nJ/Frame Voice Activity Detector Based Audio Front-end for Context-Aware System-On-Chip Applications in 32mn CMOS" IEEE Conference on Custom Integrated Circuits, Sep. 9, 2012, pp. 1-4.
European Office Action dated Dec. 14, 2017 for European Application No. 15803063.5, 1 page.
Chinese Office Action dated May 17, 2018 for Chinese Patent Application No. 201610099750.8, 26 pages (including English translation).
Final Office Action received for U.S. Appl. No. 14/628,686 dated May 11, 2018, 45 pages.
Chinese Office Action and Search Report dated Oct. 23, 2018 for Chinese Patent Application No. 201580036028.3, 18 pages (including English translation).
Raychowdhury et al., "A 2.3 nJ/Frame Voice Activity Detector-Based Audio Front-End for Context-Aware System-On-Chip Applications in 32-nm CMOS," IEEE Journal of Solid-State Circuits, May 2013, vol. 48, No. 8, 8 pages.
Chinese Office Action dated Feb. 12, 2019 for Chinese Application No. 201610099750.8, 9 pages (with translation).
Chinese Office Action dated Jan. 16, 2020 for Chinese Application No. 201580036028.3, 18 pages (with translation).
Notice of Allowance dated Jan. 25, 2019 for U.S. Appl. No. 15/224,131, 31 pages.
Chinese Office Action dated Jul. 3, 2019 for Chinese Application No. 201580036028.3, 15 pages (with translation).
European Office Action dated Aug. 2, 2019 for European Application No. 15803063.5, 11 pages.
International Search Report dated Oct. 20, 2017 for PCT Application No. PCT/US2017/044546, 14 pages.
Office Action dated May 16, 2018 for U.S. Appl. No. 15/224,131, 19 pages.
Office Action dated Sep. 10, 2018 for U.S. Appl. No. 14/628,686, 41 pages.
Notice of Allowance dated Oct. 16, 2018 for U.S. Appl. No. 15/224,131, 21 pages.
Final Office Action dated May 17, 2019 for U.S. Appl. No. 14/628,686, 60 pages.

* cited by examiner

SMART SENSOR FOR ALWAYS-ON OPERATION

TECHNICAL FIELD

The subject disclosure relates to microelectromechanical systems (MEMS) sensors.

BACKGROUND

Conventionally, mobile devices are becoming increasingly lightweight and compact. Contemporaneously, user demand for applications that are more complex, provide persistent connectivity, and/or are more feature-rich is in conflict with the desire to provide lightweight and compact devices that also provide a tolerable level of battery life before requiring recharging. Thus, the desire to reduce power consumption of such devices has resulted in various methods to place devices or systems into various "sleep" modes. For example, these methods can selectively deactivate components (e.g., processors or portions thereof, displays, backlights, communications components), can selectively slow down the clock rate of associated components (e.g., processors, memories), or can provide a combination of steps to reduce power consumption.

However, when devices are in such "sleep" modes, a signal based on a trigger event, or a wake event, (e.g., a pressed button, expiration of a preset time, device motion), can be used to wake or reactivate the device. In the case of wake events caused by an interaction with the device, these interactions can be detected by sensors and/or associated circuits in the device (e.g., buttons, switches, accelerometers). However, because such sensors and/or the circuits used to monitor the sensors are energized to be able to detect interactions with the device, e.g., to be able to monitor the device environment constantly, the sensors and their associated circuits continually drain power from the battery, even while a device is in such "sleep" modes.

In addition, circuits used to monitor the sensors typically employ general purpose logic or specific power management components thereof, which can be more power-intensive than is necessary to monitor the sensors and provide a useful trigger event or wake event. For example, decisions whether or not to wake up a device can be determined by a power management component of a processor of the device based on receiving an interrupt or control signal from the circuit including the sensor. That is, the interrupts can be sent to a relatively power-intensive microprocessor and associated circuitry based on gross inputs from relatively indiscriminant sensors. This can result in inefficient power management and reduced battery life from a single charge, because the entire processor can be fully powered up inadvertently based on inaccurate or inadvertent trigger events or wake events.

It is thus desired to provide smart sensors that improve upon these and other deficiencies. The above-described deficiencies are merely intended to provide an overview of some of the problems of conventional implementations, and are not intended to be exhaustive. Other problems with conventional implementations and techniques, and corresponding benefits of the various aspects described herein, may become further apparent upon review of the following description.

SUMMARY

The following presents a simplified summary of the specification to provide a basic understanding of some aspects of the specification. This summary is not an extensive overview of the specification. It is intended to neither identify key or critical elements of the specification nor delineate any scope particular to any embodiments of the specification, or any scope of the claims. Its sole purpose is to present some concepts of the specification in a simplified form as a prelude to the more detailed description that is presented later.

In a non-limiting example, a sensor comprising a microelectromechanical systems (MEMS) acoustic sensor is provided, according to aspects of the subject disclosure. Thus, an exemplary sensor can comprise a microelectromechanical systems (MEMS) acoustic sensor. In addition, an exemplary sensor includes a digital signal processor (DSP) configured to generate a control signal for a system processor that can be communicably coupled with the sensor. Furthermore, an exemplary sensor can include a package comprising a lid and a package substrate. For instance, the package can have a port adapted to receive acoustic waves or acoustic pressure. In addition, the package can house the MEMS acoustic sensor and the back cavity of the MEMS acoustic sensor can house the DSP. Other exemplary sensors can include a MEMS motion sensor.

Moreover, an exemplary microphone package is described. For instance, an exemplary microphone package can include a MEMS microphone and a DSP configured to control a device external to the microphone package. In a non-limiting aspect, an exemplary microphone package can have a lid and a package substrate. For instance, the microphone package can have a port that can receive acoustic pressure or acoustic waves. In another aspect, the microphone package can house the MEMS microphone and the DSP in a back cavity of the MEMS microphone. In a further non-limiting aspect, exemplary methods associated with a smart sensor are provided. Other exemplary microphone packages can include a MEMS motion sensor.

These and other embodiments are described in more detail below.

BRIEF DESCRIPTION OF THE DRAWINGS

Various non-limiting embodiments are further described with reference to the accompanying drawings, in which.

DETAILED DESCRIPTION

Overview

Figure 1:
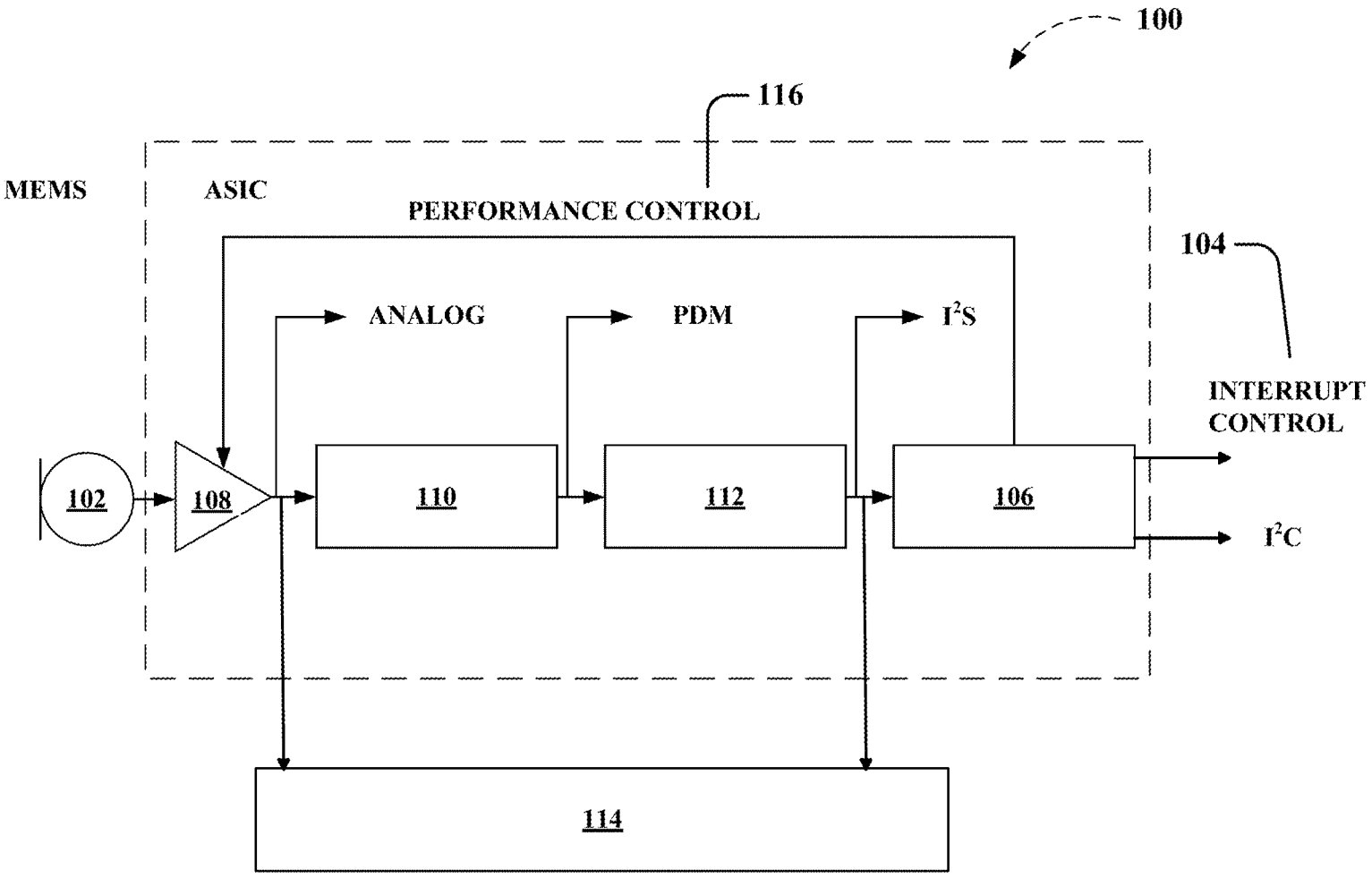
FIG. 1 depicts a functional block diagram of a microelectromechanical systems (MEMS) smart sensor, in which a MEMS acoustic sensor facilitates generating control signals with an associated digital signal processor (DSP)

While a brief overview is provided, certain aspects of the subject disclosure are described or depicted herein for the purposes of illustration and not limitation. Thus, variations of the disclosed embodiments as suggested by the disclosed apparatuses, systems, and methodologies are intended to be encompassed within the scope of the subject matter disclosed herein.

As described above, conventional power management of mobile devices can rely on relatively power-intensive microprocessor, or power management components thereof, and associated circuitry based on gross inputs from relatively indiscriminant sensors, which can result in inefficient power management and reduced battery life from a single charge.

To these and/or related ends, various aspects of smart sensors are described. For example, the various embodiments of the apparatuses, techniques, and methods of the subject disclosure are described in the context of smart sensors. Exemplary embodiments of the subject disclosure provide always-on sensors with self-contained processing, decision-making, and/or inference capabilities.

For example, according to an aspect, a smart sensor can include one or more microelectromechanical systems (MEMS) sensors communicably coupled to a digital signal processor (DSP) (e.g., an internal DSP) within a package comprising the one or more MEMS sensors and the DSP. In a further example the one or more MEMS sensors can include a MEMS acoustic sensor or microphone. In yet another example, the one or more MEMS sensors can include a MEMS accelerometer.

In various embodiments, the DSP can process signals from the one or more MEMS sensors to perform various functions, e.g., keyword recognition, external device or system processor wake-up, control of the one or more MEMS sensors, etc. In a further aspect, the DSP of the smart sensor can facilitate performance control of the one or more MEMS sensors. For instance, the smart sensor comprising the DSP can perform self-contained functions (e.g., calibration, performance adjustment, change operation modes) guided by self-sufficient analysis of a signal from the one or more MEMS sensors (e.g., a signal related to sound, related to a motion, to other signals from sensors associated with the DSP, and/or any combination thereof) in addition to generating control signals based on one or more signals from the one or more MEMS sensors. Thus, a smart sensor can also include a memory or memory buffer to hold data or information associated with the one or more MEMS sensors (e.g., sound or voice information, patterns), to facilitate generating control signals based on a rich set of environmental factors associated with the one or more MEMS sensors.

According to an aspect, a smart sensor can facilitate always-on, low power operation of the smart sensor, which can facilitate more complete power down of an associated external device or system processor. For instance, a smart sensor as described can include a clock (e.g., a 32 kilohertz (kHz) clock). In a further aspect, smart sensor as described herein can operate on a power supply voltage below 1.5 volts (V) (e.g., 1.2 V). According to various embodiments, a DSP as described herein is compatible with complementary metal oxide semiconductor (CMOS) process nodes of 90 nanometers (nm) or below, as well as other technologies. As a non-limiting example, an internal DSP can be implemented on a separate die using a 90 nm or below CMOS process, as well as other technologies, and can be packaged with a MEMS sensor (e.g., within the enclosure or back cavity of a MEMS acoustic sensor or microphone), as further described herein.

In yet another aspect of the subject disclosure, the smart sensor can control a device or system processor that is external to the smart sensor and is communicably coupled thereto, for example, such as by transmitting a control signal to the device or system processor, which control signal can be used as a trigger event or a wake event for the device or system processor. As a further example, control signals from exemplary smart sensors can be employed by systems or devices comprising the smart sensors as trigger events or wake events, to control operations of the associated systems or devices, and so on. These control signals can be based on trigger events or wake events determined by the smart sensors comprising one or more MEMS sensors (e.g., acoustic sensor, motion sensor, other sensor), which can be recognized by the DSP. Accordingly, various embodiments of the smart sensors can provide autonomous wake-up decisions to wake up other components in the system or external devices associated with the smart sensors. For instance, the DSP can include Inter-Integrated Circuit ($I^2C$) and interrupt functionality to send control signals to system processors, external devices associated with the smart sensor, and/or application processors of devices such as a feature phones, smartphones, smart watches, tablets, eReaders, netbooks, automotive navigation devices, gaming consoles or devices, wearable computing devices, and so on.

However, as further detailed below, various exemplary implementations can be applied to other areas of MEMS sensor design and packaging, without departing from the subject matter described herein.

Exemplary Embodiments

Various aspects or features of the subject disclosure are described with reference to the drawings, wherein like reference numerals are used to refer to like elements throughout. In this specification, numerous specific details are set forth in order to provide a thorough understanding of the subject disclosure. It should be understood, however, that the certain aspects of disclosure may be practiced without these specific details, or with other methods, components, parameters, etc. In other instances, well-known structures and devices are shown in block diagram form to facilitate description and illustration of the various embodiments.

FIG. 1 depicts a functional block diagram of a microelectromechanical systems (MEMS) smart sensor 100, in which a MEMS acoustic sensor or microphone 102 can facilitate generating control signals 104 (e.g., interrupt control signals, $I^2C$ signals) with an associated digital signal processor (DSP) 106, according to various non-limiting aspects of the subject disclosure. As mentioned, DSP 106 can process signals from MEMS acoustic sensor or microphone 102 to perform various functions, e.g., keyword recognition, external device or system processor wake-up, control of one or more MEMS sensors For instance, DSP 106 can include $I^2C$ and interrupt functionality to send control signal 104 to system processors (not shown), external devices (not shown) associated with the smart sensor, and/or application processors (not shown) of devices such as a feature phones, smartphones, smart watches, tablets, eReaders, netbooks, automotive navigation devices, gaming consoles or devices, wearable computing devices, and so on.

Control signals 104 can be used to control (not shown) a device or system processor (e.g., external codec or processor 114, or other device or system processor, etc.) communicably coupled with smart sensor 100. For instance, smart sensor 100 can control a device or system processor (not shown) that is external to smart sensor 100 and is communicably coupled thereto, for example, such as by transmitting control signal 104 to the device or system processor that can be used as a trigger event or a wake event for the device or system processor. As a further example, control signals 104 from smart sensor 100 can be employed by systems or devices comprising exemplary smart sensors as trigger events or wake events, to control operations of the associated systems or devices, and so on. Control signals 104 can be based on trigger events or wake events determined by smart sensor 100 comprising one or more MEMS sensors (e.g., MEMS acoustic sensor or microphone 102, motion sensor, other sensor), which can be recognized by DSP 106. Accordingly, various embodiments of smart sensor 100 can provide autonomous wake-up decisions to wake up other components in the system or external devices associated with smart sensor 100.

Smart sensor 100 can further comprise a buffer amplifier 108, an analog-to-digital converter (ADC) 110, and a decimator 112 to process signals from MEMS acoustic sensor or microphone 102. In the non-limiting example of smart sensor 100 comprising MEMS acoustic sensor or microphone 102, MEMS acoustic sensor or microphone 102 is shown communicably coupled to an external codec or processor 114 that can employ analog and/or digital audio signals (e.g., pulse density modulation (PDM) signals, Integrated Interchip Sound ($I^2S$) signals, information, and/or data) as is known in the art. However, it should be understood that external codec or processor 114 is not necessary to enable the scope of the various embodiments described herein.

In a further aspect, DSP 106 of smart sensor 100 can facilitate performance control 116 of the one or more MEMS sensors. For instance, in an aspect, smart sensor 100 comprising DSP 106 can perform self-contained functions (e.g., calibration, performance adjustment, change operation modes) guided by self-sufficient analysis of a signal from the one or more MEMS sensors (e.g., a signal from MEMS acoustic sensor or microphone 102, signal related to a motion, other signals from sensors associated with DSP 106, other signals from external device or system processor (not shown), and/or any combination thereof) in addition to generating control signals 104 based on one or more signals from one or more MEMS sensors, or otherwise.

For instance, by combining DSP 106 with MEMS sensor or microphone 102 in the sensor or microphone package and dedicating the DSP 106 to the MEMS sensor or microphone 102, DSP 106 can provide additional controls over sensor or microphone 102 performance. For example, in a non-limiting aspect, DSP 106 can switch MEMS sensor or microphone 102 into different modes. As an example, as a low-power smart sensor 100, embodiments of the subject disclosure can generate trigger events or wake events, as described. However, DSP 106 can also facilitate configuring the MEMS sensor or microphone 102 as a high-performance microphone (e.g., for voice applications) versus a low performance microphone (e.g., for generating trigger events or wake events).

Thus, smart sensor 100 can also include a memory or memory buffer (not shown) to hold data or information associated with the one or more MEMS sensors (e.g., sound or voice information, patterns), in further non-limiting aspects, to facilitate generating control signals based on a rich set of environmental factors associated with the one or more MEMS sensors.

As described, smart sensor 100 can facilitate always-on, low power operation of the smart sensor 100, which can facilitate more complete power down of an associated external device (not shown) or system processor (not shown). For instance, smart sensor 100 as described can include a clock (e.g., a 32 kilohertz (kHz) clock). In a further aspect, smart sensor 100 can operate on a power supply voltage below 1.5 V (e.g., 1.2 V). As a non-limiting example, by employing the DSP 106 with MEMS acoustic sensor or microphone 102 to provide always-on, low power operation of the smart sensor 100, system processor or external device (not shown) can be more fully powered down while maintaining smart sensor 100 awareness of a rich set of environmental factors associated with the one or more MEMS sensors (e.g., one or more of MEMS acoustic sensor or microphone 102, motion sensor).

In a further non-limiting aspect, MEMS acoustic sensor or microphone 102 and DSP 106 are provided in a common sensor or microphone package or enclosure (e.g., comprising a lid and a sensor or microphone package substrate), such as a microphone package that defines a back cavity of MEMS acoustic sensor or microphone 102, for example, as further described below regarding FIGS. 3-9. According to various embodiments, DSP 106 can be compatible with CMOS process nodes of 90 nm or below, as well as other technologies. As a non-limiting example, DSP 106 can be implemented on a separate die using a 90 nm or below CMOS process, as well as other technologies, and can be packaged with one or more MEMS sensors (e.g., within the enclosure or back cavity of MEMS acoustic sensor or microphone 102), as further described herein. In another aspect, DSP 106 can be integrated with one or more of buffer amplifier 108, ADC 110, and/or decimator 112 associated with MEMS acoustic sensor or microphone 102 into a common ASIC, for example, as further described herein, regarding FIGS. 3-9.

Figure 2:
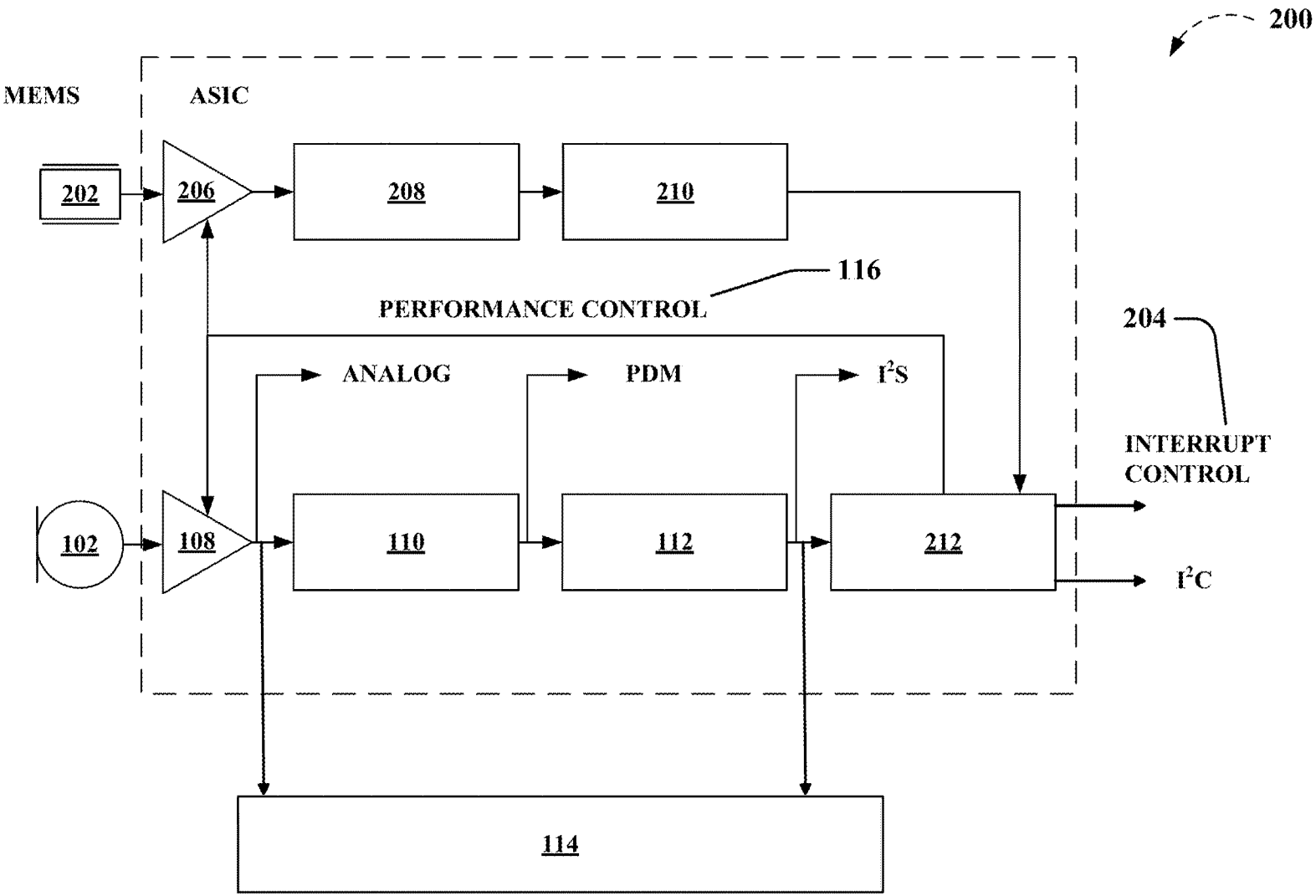
FIG. 2 depicts another functional block diagram of a MEMS smart sensor, in which a MEMS motion sensor, in conjunction with a MEMS acoustic sensor, facilitates generating control signals with an associated DSP.

FIG. 2 depicts another functional block diagram of a MEMS smart sensor 200, in which the one or more MEMS sensors comprise a MEMS motion sensor 202, in conjunction with a MEMS acoustic sensor or microphone 102, and which can facilitate generating control signals 204. In addition to functionality and capabilities described above regarding FIG. 1, FIG. 2 provides a combination MEMS smart sensor 200, which can further comprise one or more of a MEMS motion sensor 202 (e.g., a MEMS accelerometer), a buffer amplifier 206, an ADC 208, and a decimator 210 to process signals from MEMS motion sensor 202, and a DSP 212.

In a non-limiting aspect, MEMS motion sensor 202 can comprise a MEMS accelerometer. In another aspect, the MEMS accelerometer can comprise a low-G accelerometer, characterized in that a low-G accelerometer can be employed in applications for monitoring relatively low acceleration levels, such as experienced by a handheld device when the device is held in a user's hand as the user is waving his or her arm. A low-G accelerometer can be further characterized by reference to a high-G accelerometer, which can be employed in applications for monitoring relatively higher levels of acceleration, such as might be useful in automobile crash detection applications. However, it can be appreciated that various embodiments of the subject disclosure described as employing a MEMS motion sensor 202 (e.g., a MEMS accelerometer, a low-G MEMS accelerometer) are not so limited.

As with FIG. 1 above, combination sensor 200 can be connected to external codec or processor 114 that can employ analog and/or digital audio signals (e.g., PDM signals, $I^2S$ signals, information, and/or data) as is known in the art. In addition, external codec or processor 114 can employ analog and/or digital signals, information, and/or data associated with MEMS motion sensor 202. However, it should be understood external codec or processor 114 is not necessary to enable the scope of the various embodiments described herein.

As described above regarding FIG. 1, DSP 212 can process signals from the one or more MEMS sensors (e.g., one or more of MEMS acoustic sensor or microphone 102, MEMS motion sensor 202) to perform various functions, e.g., keyword recognition, external device or system processor wake-up, control of one or more MEMS sensors For instance, DSP 212 can include $I^2C$ and interrupt functionality to send control signal 204 to system processors (not shown), external devices (not shown) associated with the smart sensor, and/or application processors (not shown) of devices such as a feature phones, smartphones, smart watches, tablets, eReaders, netbooks, automotive navigation devices, gaming consoles or devices, wearable computing devices, and so on.

Control signals 204 can be used to control (not shown) a device or system processor (e.g., external codec or processor 114, or other device or system processor, etc.) communicably coupled with smart sensor 200. For instance, smart sensor 200 can control a device or system processor (not shown) that is external to smart sensor 200 and is communicably coupled thereto, for example, such as by transmitting control signal 204 to the device or system processor that can be used as a trigger event or a wake event for the device or system processor. As a further example, control signals 204 from smart sensor 200 can be employed by systems or devices comprising exemplary smart sensors as trigger events or wake events, to control operations of the associated systems or devices. For instance, control signals 204 can be based on trigger events or wake events determined by smart sensor 200 comprising one or more MEMS sensors (e.g., MEMS acoustic sensor or microphone 102, MEMS motion sensor 202, other sensor), which can be recognized by the DSP 212. Accordingly, various embodiments of smart sensor 200 can provide autonomous wake-up decisions to wake up other components in the system or external devices associated with smart sensor 200.

A non-limiting example of a trigger event or wake event input involving embodiments of the subject disclosure (e.g., comprising one or more of a MEMS acoustic sensor or microphone 102, MEMS motion sensor 202, such as a MEMS accelerometer, other sensor) could be the action of removing a mobile phone from a pocket. In this instance, smart sensor 200 can recognize the distinct sound of the mobile phone being grasped, the mobile phone rustling against the fabric of the pocket, and so on. As well, smart sensor 200 can recognize a distinct motion experienced by the mobile phone being grasped, lifted, rotated, and/or turned, and so on, to display the mobile phone to a user at a certain angle. While any one of the inputs, separately (e.g., one of the audio input from MEMS acoustic sensor or microphone 102 or accelerometer input of MEMS motion sensor 202) may not necessarily indicate a valid wake event, smart sensor 200 can recognize the combination of the two inputs as a valid wake event. Conversely, employing an indiscriminate sensor in this scenario would likely require discarding many of the inputs (e.g., the distinct sound of the mobile phone being grasped, the mobile phone rustling against the fabric of the pocket, the distinct motion experienced by the mobile phone being grasped, lifted, rotated, and/or turned, and so on) that could be employed as valid trigger events or wake events. Otherwise, employing an indiscriminate sensor in this scenario would likely result in too many false positives so as to reduce the utility of employing such an indiscriminate sensor in a power management scenario, for example, because the entire system processor or external device could be fully powered up inadvertently based on inaccurate or inadvertent trigger events or wake events.

In further exemplary embodiments, DSP 212 of smart sensor 200 can facilitate performance control 116 of the one or more MEMS sensors (e.g., one or more of MEMS acoustic sensor or microphone 102, MEMS motion sensor 202, other sensor). For instance, in an aspect, smart sensor 200 comprising DSP 212 can perform self-contained functions (e.g., calibration, performance adjustment, change operation modes) guided by self-sufficient analysis of a signal from the one or more MEMS sensors (e.g., a signal from one or more of the MEMS acoustic sensor or microphone 102, the MEMS motion sensor 202, another sensor, etc., other signals from sensors associated with DSP 212, other signals from external device or system processor (not shown), and/or any combination thereof) in addition to generating control signals 204 based on one or more signals from the one or more MEMS sensors, or otherwise.

Thus, smart sensor 200 can also include a memory or memory buffer (not shown) to hold data or information associated with the one or more MEMS sensors (e.g., sound or voice information, motion information, patterns), to facilitate generating control signal based on a rich set of environmental factors associated with the one or more MEMS sensors (e.g., one or more of MEMS acoustic sensor or microphone 102, MEMS motion sensor 202, other sensor).

As described, smart sensor 200 can facilitate always-on, low power operation of the smart sensor 200, which can facilitate more complete power down of an associated external device (not shown) or system processor (not shown). For instance, smart sensor 200 as described can include a clock (e.g., a 32 kilohertz (kHz) clock). In a further aspect, smart sensor 200 can operate on a power supply voltage below 1.5 V (e.g., 1.2 V). As a non-limiting example, by employing DSP 212 with MEMS acoustic sensor or microphone 202 and MEMS motion sensor 202 to provide always-on, low power operation of smart sensor 200, system processor or external device (not shown) can be more fully powered down while maintaining smart sensor 200 awareness of a rich set of environmental factors associated with the one or more MEMS sensors (e.g., one or more of MEMS acoustic sensor or microphone 102, MEMS motion sensor 202, other sensor).

In a further non-limiting aspect, MEMS acoustic sensor or microphone 102 and DSP 212 are provided in a common sensor or microphone package or enclosure (e.g., comprising a lid and a sensor or microphone package substrate), such as a microphone package that defines a back cavity of MEMS acoustic sensor or microphone 102, for example, as further described below regarding FIGS. 3-9. According to various embodiments, DSP 212 can be compatible with CMOS process nodes of 90 nm or below, as well as other technologies. As a non-limiting example, DSP 212 can be implemented on a separate die using a 90 nm or below CMOS process, as well as other technologies, and can be packaged with one or more MEMS sensors (e.g., within the enclosure or back cavity of MEMS acoustic sensor or microphone 102, MEMS motion sensor 202, other sensors), as further described herein. In another aspect, DSP 212 can be integrated with one or more of buffer amplifier 108, ADC 110, and/or decimator 112 associated with MEMS acoustic sensor or microphone 102, and/or with one or more of buffer amplifier 206, ADC 208, and/or decimator 210 associated with MEMS motion sensor 202 into a common ASIC, for example, as further described herein, regarding FIGS. 3-9.

Figure 3:
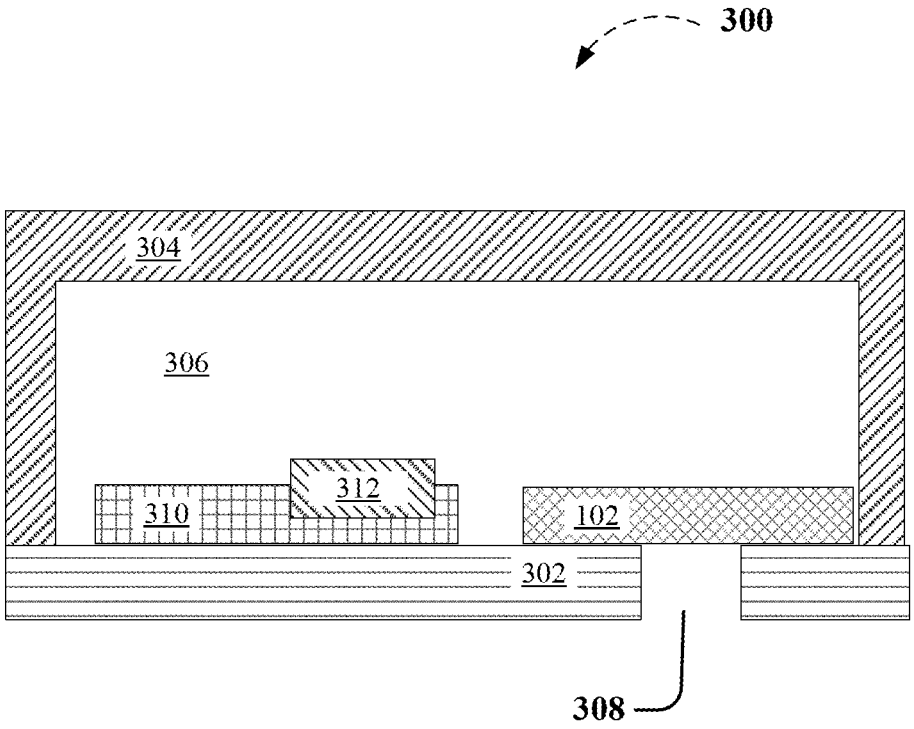
FIG. 3 depicts a non-limiting sensor or microphone package (e.g., comprising a MEMS acoustic sensor or microphone), in which a DSP can be integrated with an ASIC associated with the MEMS acoustic sensor or microphone.

FIGS. 3-7 illustrate schematic diagrams of exemplary configurations of components of MEMS smart sensors 100/200, according to various non-limiting aspects of the subject disclosure. For instance, FIG. 3 depicts a non-limiting sensor or microphone package 300 (e.g., comprising MEMS acoustic sensor or microphone 102). In an aspect, sensor or microphone package 300 can comprise an enclosure comprising a sensor or microphone package substrate 302 and a lid 304 that can house and define a back cavity 306 for MEMS acoustic sensor or microphone 102. The enclosure comprising sensor or microphone package substrate 302 and lid 304 can have a port 308 adapted to receive acoustic waves or acoustic pressure. Port 308 can also be located in lid 304 for other configurations of MEMS acoustic sensor or microphone 102 or can be omitted for certain other configurations of one or more MEMS sensors not requiring reception of acoustic waves or acoustic pressure. MEMS acoustic sensor or microphone 102 can be mechanically affixed to sensor or microphone package substrate 302 and can be communicably coupled thereto. Sensor or microphone package 300 can also comprise ASIC 310, for example, as described above regarding FIG. 1, and DSP 312 (e.g., DSP 106), which can be housed in the enclosure comprising a sensor or microphone package substrate 302 and a lid 304. In sensor or microphone package 300 depicted in FIG. 3, DSP 312 can be integrated with ASIC 310. ASIC 310 can be mechanically affixed to sensor or microphone package substrate 302 and can be communicably coupled to MEMS acoustic sensor or microphone 102 via sensor or microphone package substrate 302.

Figure 4:
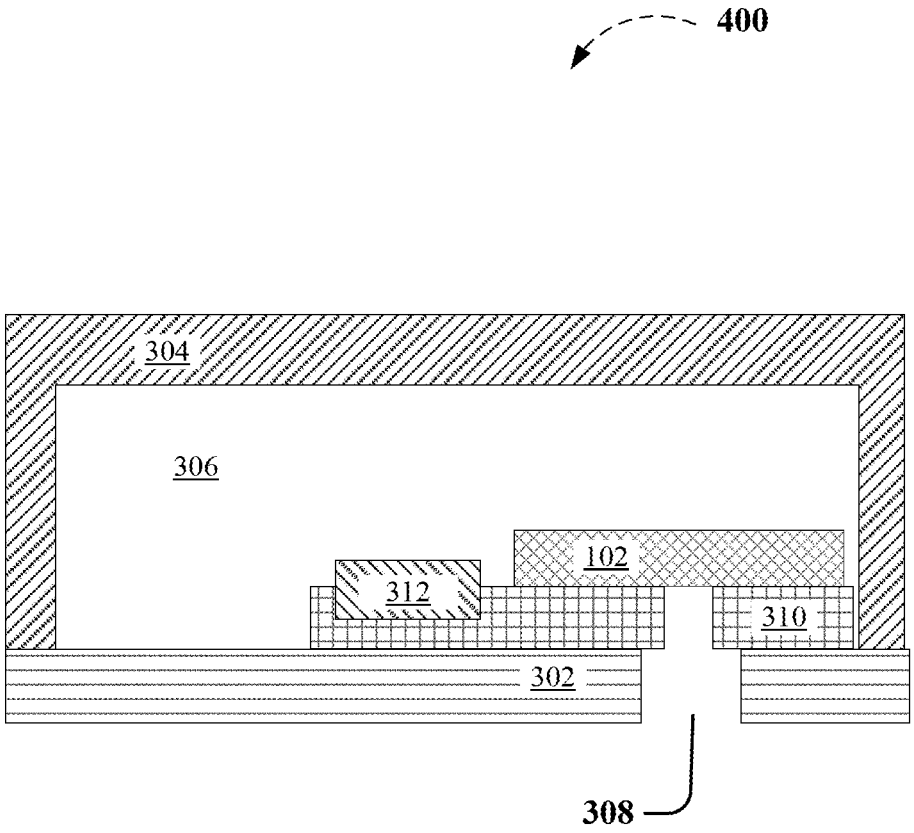
FIG. 4 depicts another sensor or microphone package (e.g., comprising a MEMS acoustic sensor or microphone), in which a MEMS acoustic sensor or microphone can be electrically coupled and mechanically affixed on top of an ASIC, in which a DSP can be integrated.
Figure 5:
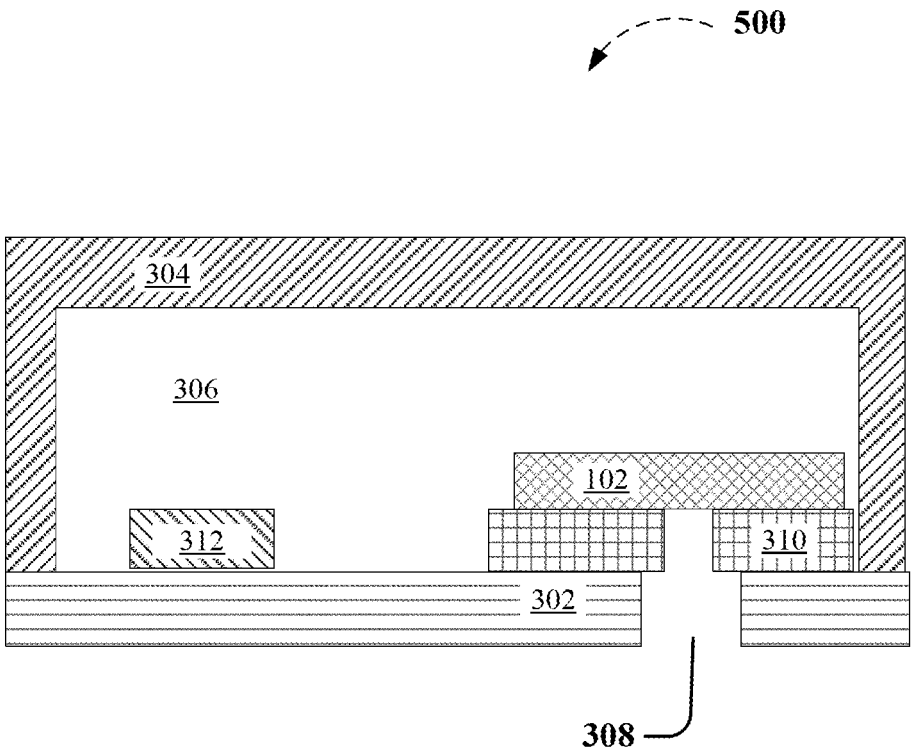
FIG. 5 depicts a further sensor or microphone package (e.g., comprising a MEMS acoustic sensor or microphone), in which a MEMS acoustic sensor or microphone is electrically coupled and mechanically affixed on top of an ASIC, and in which a standalone DSP is housed within the sensor or microphone package.

Turning to FIG. 4, for a sensor or microphone package 400, DSP 312 can be integrated with ASIC 310. ASIC 310 can be mechanically affixed to sensor or microphone package substrate 302 and can be communicably coupled thereto. MEMS acoustic sensor or microphone 102 can be mechanically affixed to ASIC 310 and can be communicably coupled thereto. FIG. 5 depicts a further sensor or microphone package 500 (e.g., comprising a MEMS acoustic sensor or microphone 102), in which MEMS acoustic sensor or microphone 102 can be communicably coupled and mechanically affixed on top of ASIC 310, and in which a standalone DSP 312 (e.g., DSP 106) can be housed within the sensor or microphone package 500. DSP 312 can be mechanically affixed to sensor or microphone package substrate 302 and can be communicably coupled to MEMS acoustic sensor or microphone 102 via sensor or microphone package substrate 302.

Figure 6:
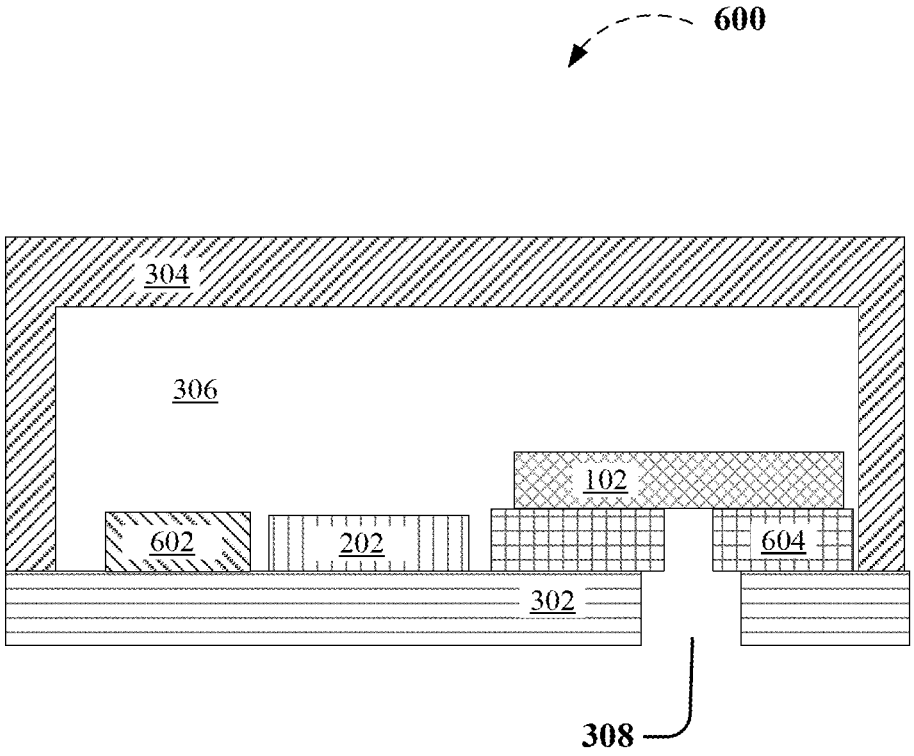
FIG. 6 depicts a non-limiting sensor or microphone package (e.g., comprising a MEMS acoustic sensor or microphone and a MEMS motion sensor), in which a standalone DSP is provided in a MEMS acoustic sensor or microphone package.
Figure 7:
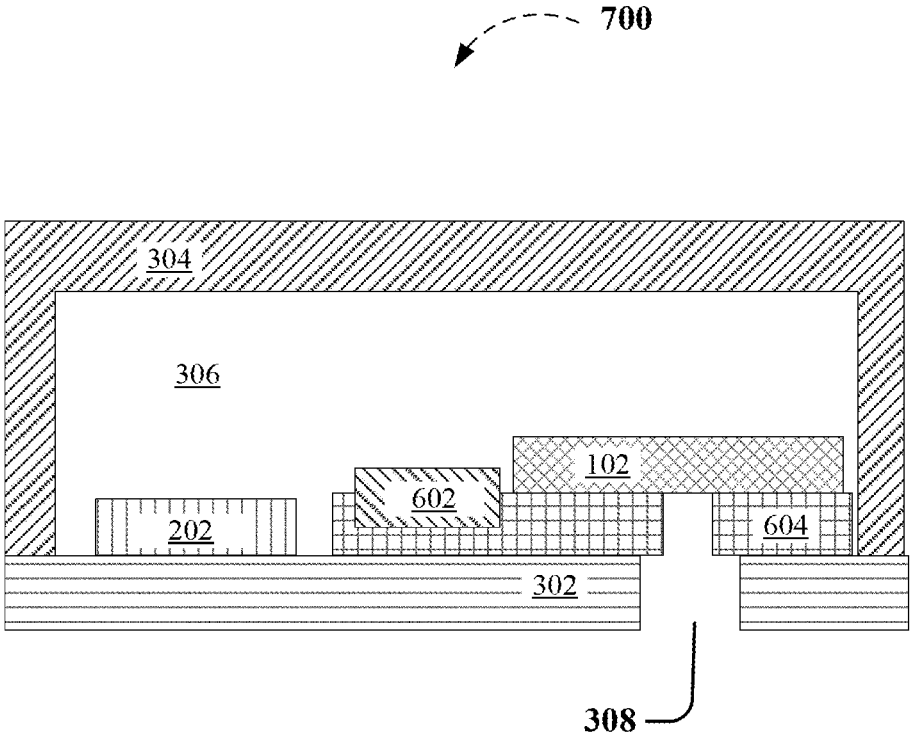
FIG. 7 depicts another sensor or microphone package (e.g., comprising a MEMS acoustic sensor or microphone and a MEMS motion sensor), in which a MEMS acoustic sensor or microphone is electrically coupled and mechanically affixed on top of an ASIC, in which a DSP is integrated.

FIG. 6 depicts a non-limiting sensor or microphone package 600 (e.g., comprising a MEMS acoustic sensor or microphone 102 and a MEMS motion sensor 202), in which a standalone DSP 602 (e.g., DSP 212) can be provided in the MEMS acoustic sensor or microphone package 600. DSP 602 and MEMS motion sensor 202 can be mechanically affixed to sensor or microphone package substrate 302 and can be communicably coupled thereto. Sensor or microphone package 600 can also comprise ASIC 604, for example, as described above regarding FIG. 2. MEMS acoustic sensor or microphone 102 can be mechanically affixed to ASIC 604 and can be communicably coupled thereto as described above regarding FIG. 4. FIG. 7 depicts another sensor or microphone package 700 (e.g., comprising a MEMS acoustic sensor or microphone 102 and a MEMS motion sensor 202), in which MEMS acoustic sensor or microphone 102 can communicably coupled and can be mechanically affixed on top of ASIC 604, in which DSP 602 can be integrated.

Figure 8:
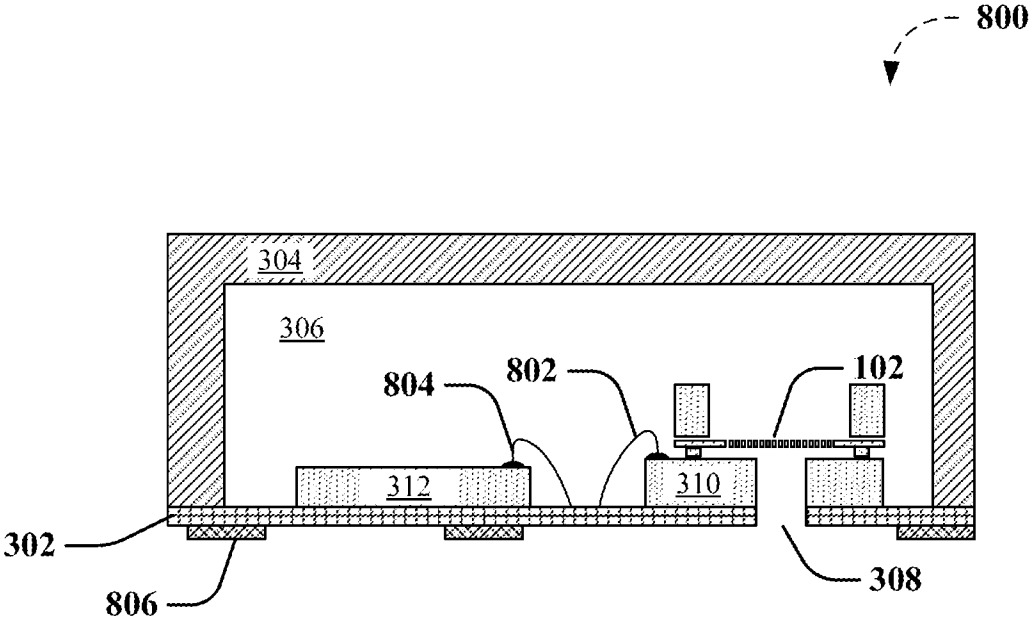
FIG. 8 illustrates a schematic cross section of an exemplary smart sensor, in which a MEMS acoustic sensor or microphone facilitates generating control signals with an associated DSP.

FIG. 8 illustrates a schematic cross section of an exemplary smart sensor 800, in which a MEMS acoustic sensor or microphone 102 facilitates generating control signal 104 with an associated DSP 312 (e.g., DSP 106), according to various aspects of the subject disclosure. Smart sensor 800 can include MEMS acoustic sensor or microphone 102 in an enclosure comprising a sensor or microphone package substrate 302 and a lid 304 that can house and define a back cavity 306 for MEMS acoustic sensor or microphone 102. Smart sensor 800 can further comprise DSP 312 (e.g., DSP 106), which can be housed in the enclosure comprising a sensor or microphone package substrate 302 and a lid 304. As above, the enclosure comprising package substrate 302 and lid 304 can have a port 308, or otherwise, adapted to receive acoustic waves or acoustic pressure. ASIC 310 can be mechanically affixed to sensor or microphone package substrate 302 and can be communicably coupled thereto via wire bond 802. MEMS acoustic sensor or microphone 102 can be mechanically affixed to ASIC 310 and can be communicably coupled thereto. DSP 312 can be mechanically affixed to sensor or microphone package substrate 302 and can be communicably coupled thereto via wire bond 804. Solder 806 on sensor or microphone package substrate 302 can facilitate connecting smart sensor 800 to an external substrate such as a customer printed circuit board (PCB) (not shown).

Figure 9:
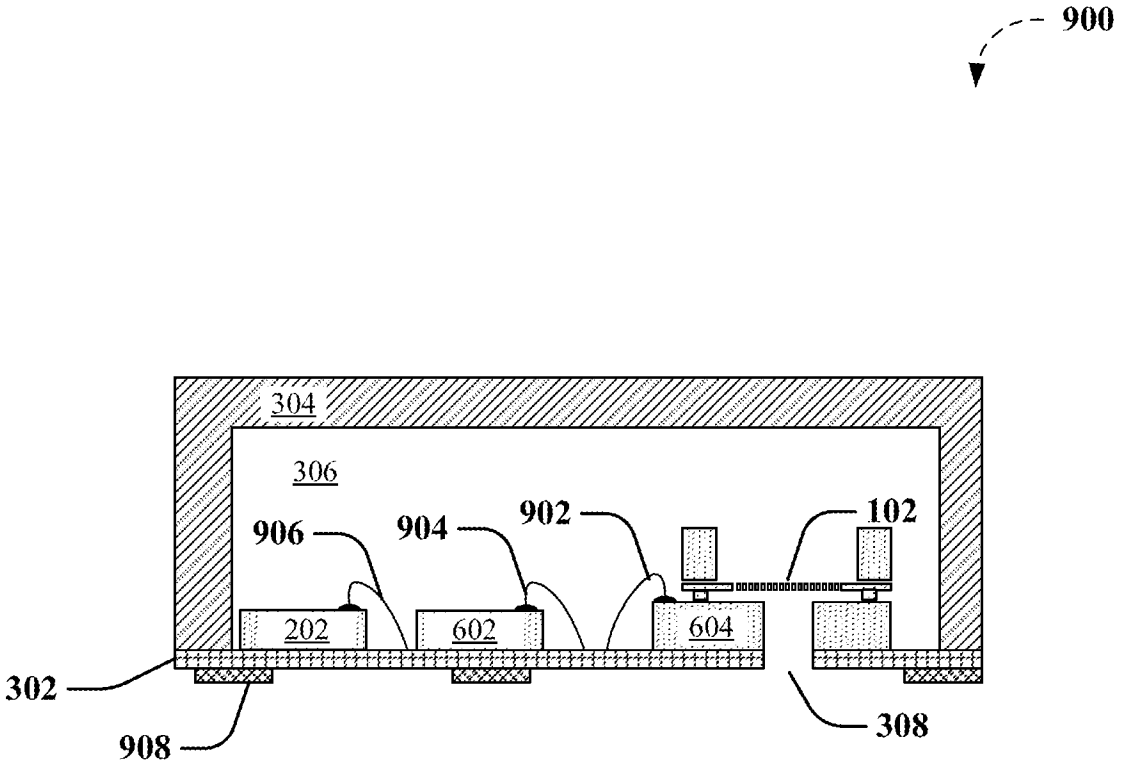
FIG. 9 illustrates a schematic cross section of a further exemplary smart sensor, in which a MEMS motion sensor, in conjunction with a MEMS acoustic sensor, facilitates generating control signals with an associated DSP.

FIG. 9 illustrates a schematic cross section of a further non-limiting smart sensor 900, in which a MEMS motion sensor 202, in conjunction with a MEMS acoustic sensor or microphone 102, facilitates generating control signals 204 with an associated DSP 602 (e.g., DSP 212), according to further non-limiting aspects of the subject disclosure. Smart sensor 900 can include one or more of MEMS acoustic sensor or microphone 102, MEMS motion sensor 202, and so on, in an enclosure comprising a sensor or microphone package substrate 302 and a lid 304 that can house MEMS acoustic sensor or microphone 102 and MEMS motion sensor 202 and define a back cavity 306 for MEMS acoustic sensor or microphone 102. Smart sensor 900 can further comprise DSP 602 (e.g., DSP 212), which can be housed in the enclosure comprising a sensor or microphone package substrate 302 and a lid 304. As described, the enclosure comprising package substrate 302 and lid 304 can have a port 308, or otherwise, adapted to receive acoustic waves or acoustic pressure. ASIC 604 can be mechanically affixed to sensor or microphone package substrate 302 and can be communicably coupled thereto via wire bond 902. MEMS acoustic sensor or microphone 102 can be mechanically affixed to ASIC 604 and can be communicably coupled thereto. DSP 602 can be mechanically affixed to sensor or microphone package substrate 302 and can be communicably coupled thereto via wire bond 904. MEMS motion sensor 202 can be mechanically affixed to sensor or microphone package substrate 302 and can be communicably coupled thereto via wire bond 906. Solder 908 on sensor or microphone package substrate 302 can facilitate connecting smart sensor 900 to an external substrate such as a customer printed circuit board (PCB) (not shown).

Figure 10:
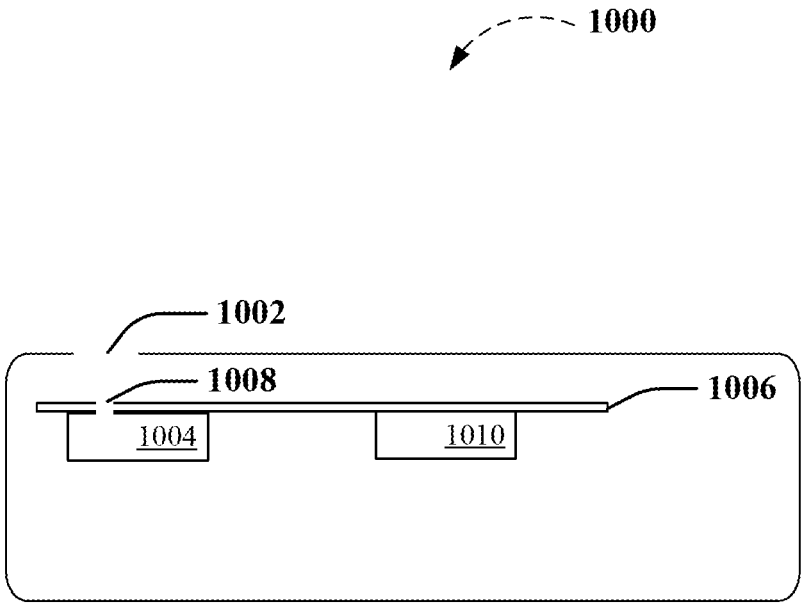
FIG. 10 illustrates a block diagram representative of an exemplary application of a smart sensor.

FIG. 10 illustrates a block diagram representative of an exemplary application of a smart sensor according to further aspects of the subject disclosure. More specifically, a block diagram of a host system 1000 is shown to include an acoustic port 1002 and a smart sensor 1004 (e.g., comprising one or more of MEMS acoustic sensor or microphone 102, MEMS motion sensor 202, other sensors) affixed to a PCB 1006 having an orifice 1008 or other means of passing acoustic waves or pressure to smart sensor 1004. In addition, host system 1000 can comprise a device 1010, such as a system processor, an external device associated with smart sensor 1004, and/or an application processor, that can be mechanically affixed to PCB 1006 and can be communicably coupled to smart sensor 1004, to facilitate receiving control signals 104/204, and/or other information and/or data, from smart sensor 1004. Examples of the smart sensor 1004 can comprise a smart sensor (e.g., comprising one or more of MEMS acoustic sensor or microphone 102, MEMS motion sensor 202, other sensors) as described herein regarding FIGS. 1-9. The host system 1000 can be any system requiring smart sensors, such as feature phones, smartphones, smart watches, tablets, eReaders, netbooks, automotive navigation devices, gaming consoles or devices, wearable computing devices, and so on.

While various embodiments of a smart sensor (e.g., comprising one or more of MEMS acoustic sensor or microphone 102, MEMS motion sensor 202, other sensors) according to aspects of the subject disclosure have been described herein for purposes of illustration, and not limitation, it can be appreciated that the subject disclosure is not so limited. Various implementations can be applied to other areas of MEMS sensor design and packaging, without departing from the subject matter described herein. For instance, it can be appreciated that other applications requiring smart sensors as described can include remote monitoring and/or sensing devices, whether autonomous or semi-autonomous, and whether or not such remote monitoring and/or sensing devices involve applications employing a acoustic sensor or microphone. For instance, various techniques, as described herein, employing a DSP within a sensor package can facilitate improved power management and battery life for a single charge by providing, for example, more intelligent and/or discriminating recognition of trigger events or wake events. As a result, other embodiments or applications of smart sensors can include, but are not limited to, applications involving sensors associated with measuring temperature, pressure, humidity, light, and/or other electromagnetic radiation (e.g., such as communication signals), and/or other sensors associated with measuring other physical, chemical, or electrical phenomena.

Accordingly, in various aspects, the subject disclosure provides a sensor comprising a MEMS acoustic sensor (e.g., MEMS acoustic sensor or microphone 102) having or associated with a back cavity (e.g., back cavity 306), for example, regarding FIGS. 1-10. In a further exemplary embodiment, as described above regarding FIGS. 1 and 2, for example, the sensor can be configured to operate at a voltage below 1.5 volts. In a further aspect, the sensor can be configured to operate in an always-on mode, as described herein. For example, the sensor can be included in a device such as host system 1000 (e.g., a feature phone, smartphone, smart watch, tablet, eReader, netbook, automotive navigation device, gaming console or device, wearable computing device) comprising a system processor (e.g., device 1010), wherein the system processor (e.g., device 1010) is located outside the package. For example, system processor (e.g., device 1010) can include an integrated circuit (IC) for controlling functionality of a mobile phone (e.g., host system 1000).

The sensor can further comprise a DSP (e.g., DSP 106/212), located in the back cavity (e.g., back cavity 306), which DSP can be configured to generate a control signal (e.g., control signal 104/204) for the system processor (e.g., device 1010 communicably coupled with the sensor) in response to receiving a signal from the MEMS acoustic sensor (e.g., MEMS acoustic sensor or microphone 102). In addition, the sensor can comprise a package that can include a lid (e.g., lid 304) and a package substrate (e.g., sensor or microphone package substrate 302), for example, as described above regarding FIGS. 3-9. In an aspect, the package can have a port (e.g., port 308) that can be adapted to receive acoustic waves or acoustic pressure. In a further aspect, the package can house the MEMS acoustic sensor (e.g., sensor or microphone package substrate 302) and can define the back cavity (e.g., back cavity 306) of the MEMS acoustic sensor (e.g., sensor or microphone package substrate 302). In another non-limiting aspect, the sensor can further comprise a MEMS motion sensor (e.g., MEMS motion sensor 202).

The DSP (e.g., DSP 106/212) can comprise an ASIC, for instance, as described above. In a further aspect the DSP (e.g., DSP 106/212) can be configured to generate a wake-up signal in response to processing the signal from the MEMS acoustic sensor (e.g., MEMS acoustic sensor or microphone 102, MEMS motion sensor 202). As a result, the DSP (e.g., DSP 106/212) can comprise a wake-up module configured to wake up the system processor (e.g., device 1010) according to a trigger event or wake event, as recognized and/or inferred by DSP (e.g., DSP 106/212). In a further non-limiting aspect, the DSP (e.g., DSP 106/212) can be configured to generate the control signal 104/204 in response to receiving one or more of a signal from the MEMS motion sensor (e.g., MEMS motion sensor 202) or the signal from the MEMS acoustic sensor (e.g., MEMS acoustic sensor or microphone 102), a signal from other sensors, a signal from other devices are processors such as the system processor (e.g., device 1010), and so on.

In addition, the DSP (e.g., DSP 106/212) can be further configured to, or can comprise a sensor control module configured to, control one or more of the MEMS motion sensor (e.g., MEMS motion sensor 202), the MEMS acoustic sensor (e.g., MEMS acoustic sensor or microphone 102), etc., for example, as further described above regarding FIGS. 1-2. For instance, a sensor control module as described herein can be configured to perform self-contained functions (e.g., calibration, performance adjustment, change operation modes) guided by self-sufficient analysis of a signal from the one or more MEMS sensors (e.g., a signal from one or more of the MEMS acoustic sensor or microphone 102, the MEMS motion sensor 202, another sensor, etc., other signals from sensors associated with the DSP (e.g., DSP 106/212), other signals from external device or system processor (e.g., device 1010), and/or any combination thereof). Thus, in a further non-limiting aspect, the DSP (e.g., DSP 106/212), comprising the sensor control module, for example, can be configured to perform such sensor control functions, for example, in response to receiving one or more of a signal from the MEMS motion sensor (e.g., MEMS motion sensor 202) or the signal from the MEMS acoustic sensor (e.g., MEMS acoustic sensor or microphone 102), a signal from other sensors, a signal from other devices are processors such as the system processor (e.g., device 1010), and so on. Accordingly, DSP (e.g., DSP 106/212), or a sensor control module associated with DSP (e.g., DSP 106/212), can be configured to, among other things, calibrate, adjust performance of, or change operating mode of one or more of the MEMS acoustic sensor (e.g., MEMS acoustic sensor or microphone 102), the MEMS motion sensor (e.g., MEMS motion sensor 202), another sensor, etc.

However, various exemplary implementations of the sensor as described can additionally, or alternatively, include other features or functionality of sensors, smart sensors, microphones, sensors or microphone packages, and so on, as further detailed herein, for example, regarding FIGS. 1-10.

In further exemplary embodiments, the subject disclosure provides a microphone package (e.g., a sensor or microphone package comprising a MEMS acoustic sensor or microphone 102), for example, as further described above regarding FIGS. 1-10. In a further exemplary embodiment, as described above regarding FIGS. 1 and 2, for example, the microphone package can be configured to operate at a voltage below 1.5 volts. In a further aspect, the microphone package can be configured to operate in an always-on mode, as described herein. For example, the microphone package can be included in a device or system such as host system 1000 (e.g., a feature phone, smartphone, smart watch, tablet, eReader, netbook, automotive navigation device, gaming console or device, wearable computing device) comprising a system processor (e.g., device 1010), wherein the system processor (e.g., device 1010) is located outside the package. For example, system processor (e.g., device 1010) can include an integrated circuit (IC) for controlling functionality of a mobile phone (e.g., host system 1000).

Accordingly, a microphone package (e.g., a sensor or microphone package comprising a MEMS acoustic sensor or microphone 102) can comprise a MEMS microphone (e.g., MEMS acoustic sensor or microphone 102) having or associated with a back cavity (e.g., back cavity 306). The microphone package can further comprise a DSP (e.g., DSP 106/212), located in the back cavity (e.g., back cavity 306), which DSP can be configured to control a device (e.g., device 1010) external to the microphone package via a control signal (e.g., control signal 104/204). For instance, the microphone package can comprise a lid (e.g., lid 304) and a package substrate (e.g., sensor or microphone package substrate 302), for example, as described above regarding FIGS. 3-9. In an aspect, the microphone package can have a port (e.g., port 308) that can be adapted to receive acoustic waves or acoustic pressure. In a further aspect, the microphone package defines the back cavity (e.g., back cavity 306). In another aspect, the microphone package can house the MEMS microphone (e.g., sensor or microphone package substrate 302) and the DSP (e.g., DSP 106/212). In another non-limiting aspect, the microphone package can further comprise a MEMS motion sensor (e.g., MEMS motion sensor 202).

The DSP (e.g., DSP 106/212) can comprise an ASIC, for instance, as described above. In a further aspect the DSP (e.g., DSP 106/212) can be configured to generate a wake-up signal in response to processing the signal from the MEMS microphone (e.g., MEMS acoustic sensor or microphone 102, MEMS motion sensor 202). As a result, the DSP (e.g., DSP 106/212) can comprise a wake-up component configured to wake up the device (e.g., device 1010) according to a trigger event or wake event, as recognized and/or inferred by DSP (e.g., DSP 106/212). In a further non-limiting aspect, the DSP (e.g., DSP 106/212) can be configured to generate the control signal 104/204 in response to receiving one or more of a signal from the MEMS motion sensor (e.g., MEMS motion sensor 202) or the signal from the MEMS microphone (e.g., MEMS acoustic sensor or microphone 102), a signal from other sensors, a signal from other devices are processors such as the device (e.g., device 1010), and so on.

In addition, the DSP (e.g., DSP 106/212) can further comprise a sensor control component configured to control one or more of the MEMS motion sensor (e.g., MEMS motion sensor 202), the MEMS microphone (e.g., MEMS acoustic sensor or microphone 102), etc., for example, as further described above regarding FIGS. 1-2. For instance, a sensor control component as described herein can be configured to perform self-contained functions (e.g., calibration, performance adjustment, change operation modes) guided by self-sufficient analysis of a signal from the one or more MEMS sensors (e.g., a signal from one or more of the MEMS acoustic sensor or microphone 102, the MEMS motion sensor 202, another sensor, etc., other signals from sensors associated with the DSP (e.g., DSP 106/212), other signals from external device or system processor (e.g., device 1010), and/or any combination thereof). Thus, in a further non-limiting aspect, the DSP (e.g., DSP 106/212) comprising the sensor control component can be configured to perform such sensor control functions, for example, in response to receiving one or more of a signal from the MEMS motion sensor (e.g., MEMS motion sensor 202) or the signal from the MEMS microphone (e.g., MEMS acoustic sensor or microphone 102), a signal from other sensors, a signal from other devices are processors such as the system processor (e.g., device 1010), and so on. Accordingly, a sensor control component associated with DSP (e.g., DSP 106/212) can be configured to, among other things, calibrate, adjust performance of, or change operating mode of one or more of the MEMS microphone (e.g., MEMS acoustic sensor or microphone 102), the MEMS motion sensor (e.g., MEMS motion sensor 202), another sensor, etc.

However, various exemplary implementations of the sensor as described can additionally, or alternatively, include other features or functionality of sensors, smart sensors, microphones, sensors or microphone packages, and so on, as further detailed herein, for example, regarding FIGS. 1-10.

Figure 11:
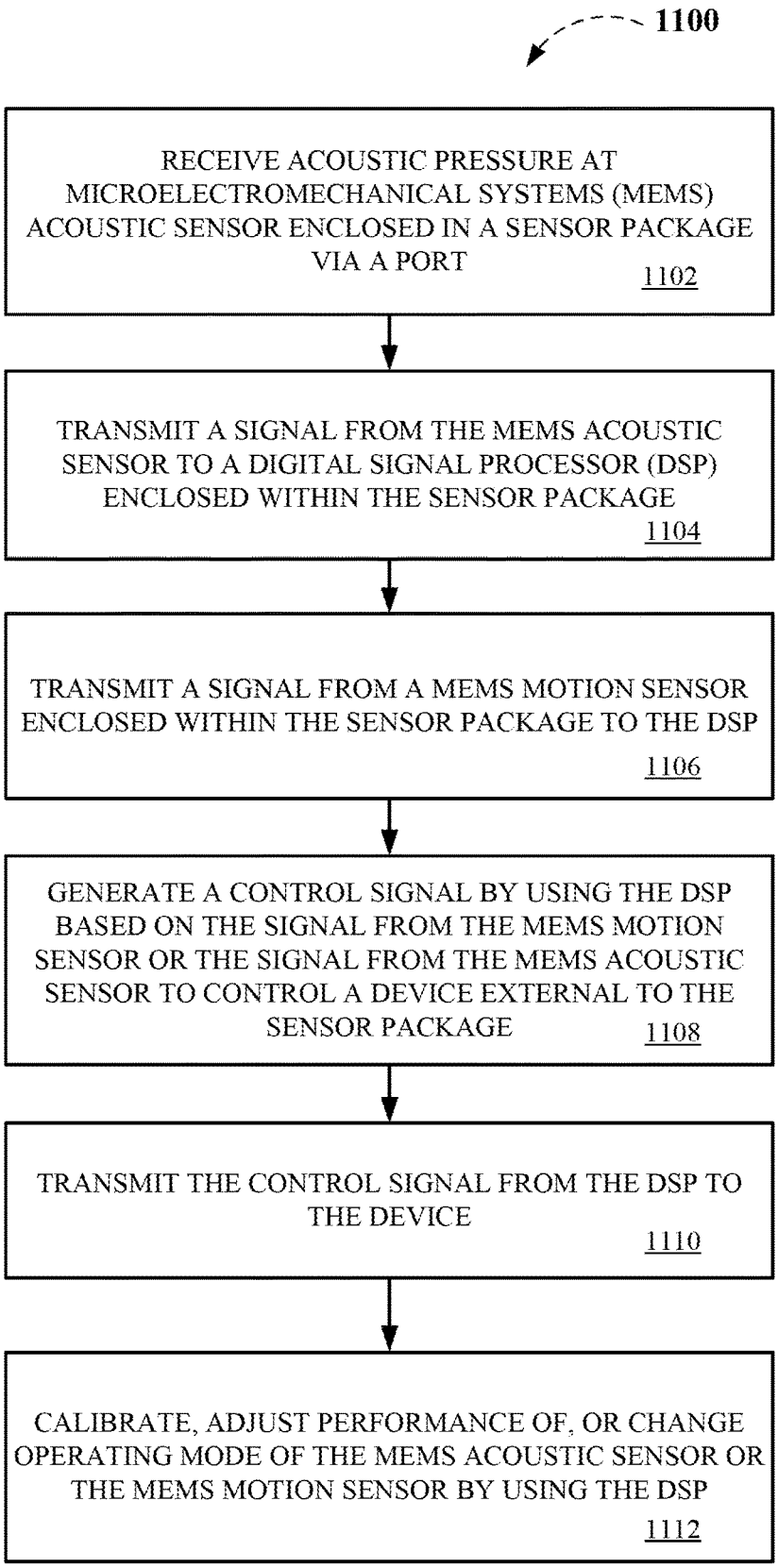
FIG. 11 depicts an exemplary flowchart of non-limiting methods associated with a smart sensor.

In view of the subject matter described supra, methods that can be implemented in accordance with the subject disclosure will be better appreciated with reference to the flowcharts of FIG. 11. While for purposes of simplicity of explanation, the methods are shown and described as a series of blocks, it is to be understood and appreciated that such illustrations or corresponding descriptions are not limited by the order of the blocks, as some blocks may occur in different orders and/or concurrently with other blocks from what is depicted and described herein. Any non-sequential, or branched, flow illustrated via a flowchart should be understood to indicate that various other branches, flow paths, and orders of the blocks, can be implemented which achieve the same or a similar result. Moreover, not all illustrated blocks may be required to implement the methods described hereinafter.

Exemplary Methods

FIG. 11 depicts an exemplary flowchart of non-limiting methods associated with a smart sensor, according to various non-limiting aspects of the subject disclosure. As a non-limiting example, exemplary methods 1100 can comprise receiving acoustic pressure or acoustic waves at 1102. For instance, acoustic pressure or acoustic waves can be received by a MEMS acoustic sensor (e.g., MEMS acoustic sensor or microphone 102) enclosed in a sensor package (e.g., a sensor or microphone package comprising a MEMS acoustic sensor or microphone 102) comprising a lid (e.g., lid 304) and a package substrate (e.g., sensor or microphone package substrate 302) via a port (e.g., port 308) in the sensor package (e.g., a sensor or microphone package comprising a MEMS acoustic sensor or microphone 102) adapted to receive the acoustic pressure or acoustic waves) for example, as described above regarding FIGS. 3-9.

In an aspect, as described above regarding FIGS. 1 and 2, for example, the MEMS acoustic sensor (e.g., MEMS acoustic sensor or microphone 102) can be configured to operate at a voltage below 1.5 volts. In a further aspect, the MEMS acoustic sensor (e.g., MEMS acoustic sensor or microphone 102) can be configured to operate in an always-on mode, as described herein. For example, the MEMS acoustic sensor (e.g., MEMS acoustic sensor or microphone 102) can be included in a device such as host system 1000 (e.g., a feature phone, smartphone, smart watch, tablet, eReader, netbook, automotive navigation device, gaming console or device, wearable computing device) comprising a system processor (e.g., device 1010) and the MEMS acoustic sensor (e.g., MEMS acoustic sensor or microphone 102), wherein the system processor (e.g., device 1010) is located outside the sensor package. For example, system processor (e.g., device 1010) can include an integrated circuit (IC) for controlling functionality of a mobile phone (e.g., host system 1000).

Exemplary methods 1100 can further comprise transmitting a signal from the MEMS acoustic sensor (e.g., MEMS acoustic sensor or microphone 102) to a DSP (e.g., DSP 106/212) enclosed within a back cavity (e.g., back cavity 306) of the MEMS acoustic sensor (e.g., MEMS acoustic sensor or microphone 102) at 1104. At 1106, exemplary methods 1100 transmitting a signal from a MEMS motion sensor (e.g., MEMS motion sensor 202) enclosed within the sensor package to the DSP (e.g., DSP 106/212).

In a further non-limiting aspect, exemplary methods 1100, at 1108, can comprise generating a control signal (e.g., control signal 104/204) by using the DSP (e.g., DSP 106/212), wherein the control signal (e.g., DSP 106/212) can be adapted to facilitate controlling a device, such as system processor (e.g., device 1010), external to the sensor package, as further described herein. As a non-limiting example, generating the control signal (e.g., control signal 104/204) by using the DSP (e.g., DSP 106/212) can include generating the control signal (e.g., control signal 104/204) based on one or more of the signal from the MEMS motion sensor (e.g., MEMS motion sensor 202), the signal from the (e.g., MEMS acoustic sensor or microphone 102), signals from other sensors, and/or any combination thereof.

For instance, generating the control signal (e.g., control signal 104/204) with the DSP (e.g., DSP 106/212) can include generating a wake-up signal adapted to facilitate powering up the device, such as system processor (e.g., device 1010), from a low-power state. As such, at 1110, exemplary methods 1100 can further comprise transmitting the control signal (e.g., control signal 104/204) from the DSP (e.g., DSP 106/212) to the device, such as system processor (e.g., device 1010) to facilitate powering up the device. In addition, at 1112, exemplary methods 1100 can also comprise calibrating, adjusting performance of, or changing operating mode of one or more of the MEMS motion sensor (e.g., MEMS motion sensor 202) or the (e.g., MEMS acoustic sensor or microphone 102) by using the DSP (e.g., DSP 106/212).

However, various exemplary implementations of exemplary methods 1100 as described can additionally, or alternatively, include other process steps associated with features or functionality of sensors, smart sensors, microphones, sensors or microphone packages, and so on, as further detailed herein, for example, regarding FIGS. 1-10.

What has been described above includes examples of the embodiments of the subject disclosure. It is, of course, not possible to describe every conceivable combination of configurations, components, and/or methods for purposes of describing the claimed subject matter, but it is to be appreciated that many further combinations and permutations of the various embodiments are possible. Accordingly, the claimed subject matter is intended to embrace all such alterations, modifications, and variations that fall within the spirit and scope of the appended claims. While specific embodiments and examples are described in subject disclosure for illustrative purposes, various modifications are possible that are considered within the scope of such embodiments and examples, as those skilled in the relevant art can recognize.

As used in this application, the terms "component," "module," "device" and "system" are intended to refer to a computer-related entity, either hardware, a combination of hardware and software, software, or software in execution. As one example, a component or module can be, but is not limited to being, a process running on a processor, a processor or portion thereof, a hard disk drive, multiple storage drives (of optical and/or magnetic storage medium), an object, an executable, a thread of execution, a program, and/or a computer. By way of illustration, both an application running on a server and the server can be a component or module. One or more components or modules scan reside within a process and/or thread of execution, and a component or module can be localized on one computer or processor and/or distributed between two or more computers or processors.

As used herein, the term to "infer" or "inference" refer generally to the process of reasoning about or inferring states of the system, and/or environment from a set of observations as captured via events, signals, and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources.

In addition, the words "example" or "exemplary" is used herein to mean serving as an example, instance, or illustration. Any aspect or design described herein as "exemplary" is not necessarily to be construed as preferred or advantageous over other aspects or designs. Rather, use of the word, "exemplary," is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

In addition, while an aspect may have been disclosed with respect to only one of several embodiments, such feature may be combined with one or more other features of the other embodiments as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed is:

1. A sensor, comprising:

a microelectromechanical systems (MEMS) acoustic sensor configured to generate an audio signal and associated with a back cavity;

a digital signal processor (DSP) located in the back cavity and configured to generate a control signal, comprising at least one of an interrupt control signal or an Inter-Integrated Circuit ($I^2C$) signal and separate from the audio signal, for a system processor external to the MEMS acoustic sensor, in response to receiving a signal from the MEMS acoustic sensor, wherein the control signal is based at least in part on the audio signal, and wherein the DSP is configured to calibrate the MEMS acoustic sensor; and a package comprising a lid and a package substrate, wherein the package has a port adapted to receive acoustic waves, and wherein the package houses the MEMS acoustic sensor and defines the back cavity associated with the MEMS acoustic sensor.

2. The sensor of claim 1, wherein the DSP is configured to generate a wake-up signal in response to processing the signal from the MEMS acoustic sensor.

3. The sensor of claim 1, wherein DSP comprises an application specific integrated circuit (ASIC).

4. The sensor of claim 1, wherein the DSP comprises a wake-up module configured to wake up the system processor.

5. The sensor of claim 4, further comprising:

a device comprising the system processor and the sensor, wherein the system processor is located outside the package.

6. The sensor of claim 5, wherein the system processor includes an integrated circuit (IC) for controlling functionality of a mobile phone.

7. The sensor of claim 1, wherein the DSP further comprises a sensor control module configured to control the MEMS acoustic sensor.

8. The sensor of claim 1, further comprising:

a MEMS motion sensor.

9. The sensor of claim 8, wherein the DSP is configured to generate the control signal in response to receiving at least one of a signal from the MEMS motion sensor or the signal from the MEMS acoustic sensor.

10. The sensor of claim 8, wherein the DSP is configured to control the MEMS motion sensor.

11. The sensor of claim 8, wherein the DSP is further configured to at least one of adjust performance of or change operating mode of at least one of the MEMS acoustic sensor or the MEMS motion sensor or calibrate the MEMS motion sensor.

12. The sensor of claim 1, wherein the DSP is further configured to perform an analysis of the audio signal and calibrate the MEMS acoustic sensor based at least in part on the analysis.

13. The sensor of claim 1, wherein the sensor is configured to operate in an always-on mode.

14. A microphone package, comprising:

a microelectromechanical systems (MEMS) microphone configured to generate an audio signal and associated with a back cavity;

a digital signal processor (DSP) located in the back cavity configured to control a device external to the microphone package based at least in part on a control signal comprising at least one of an interrupt control signal or an Inter-Integrated Circuit ($I^2C$) signal, wherein the control signal is distinct from the audio signal, and wherein the DSP is configured to calibrate the MEMS microphone; and the microphone package comprising a lid and a package substrate, wherein the microphone package has a port adapted to receive acoustic pressure, and wherein the microphone package defines the back cavity.

15. The microphone package of claim 14, further comprising:

a MEMS motion sensor.

16. The microphone package of claim 15, wherein the DSP is further configured to at least one of adjust performance of or change operating mode of at least one of the MEMS acoustic sensor or the MEMS motion sensor or calibrate the MEMS motion sensor.

17. The microphone package of claim 16, wherein the DSP is configured to control the device based at least in part on receiving at least one of a signal from the MEMS motion sensor or a signal from the MEMS microphone.

18. A method comprising:

receiving acoustic pressure at microelectromechanical systems (MEMS) acoustic sensor enclosed in a sensor package comprising a lid and a package substrate via a port in the sensor package that is adapted to receive the acoustic pressure;

transmitting an audio signal from the MEMS acoustic sensor to a digital signal processor (DSP) enclosed within a back cavity of the MEMS acoustic sensor;

calibrating the MEMS acoustic sensor with the DSP based at least in part on the audio signal; and generating a control signal comprising at least one of an interrupt control signal or an Inter-Integrated Circuit ($I^2C$) signal, based on the audio signal, by using the DSP, wherein the control signal is adapted to facilitate controlling a device external to the sensor package.

19. The method of claim 18, further comprising:

transmitting the control signal from the DSP to the device.

20. The method of claim 18, wherein the generating the control signal by using the DSP comprises generating a wake-up signal adapted to facilitate powering up the device from a low-power state.

21. The method of claim 18, where in the generating the control signal is based on the audio signal from the MEMS acoustic sensor.

22. The method of claim 18, further comprising:

transmitting a signal from a MEMS motion sensor enclosed within the sensor package to the DSP.

23. The method of claim 22, wherein the generating the control signal is based on at least one of the audio signal from the MEMS motion sensor or the signal from the MEMS acoustic sensor.

24. The method of claim 21, further comprising:

at least one of calibrating, adjusting performance of, or changing operating mode of at least one of the MEMS acoustic sensor or the MEMS motion sensor by using the DSP.

25. The method of claim 21, further comprising:

analyzing the audio signal from the MEMS acoustic sensor with the DSP and altering a calibration of the MEMS acoustic sensor based at least in part on the analyzing.

* * * * *